US007077790B1

(12) United States Patent
Krull

(10) Patent No.: US 7,077,790 B1
(45) **Date of Patent: *Jul. 18, 2006**

(54) ADJUSTABLE WEIGHT EXERCISE METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 2 days.

This patent is subject to a terminal disclaimer.

(21) Appl. No.: 10/824,338

(22) Filed: Apr. 13, 2004

Related U.S. Application Data

(63) Continuation of application No. 10/345,427, filed on Jan. 15, 2003, now Pat. No. 6,719,674.

(60) Provisional application No. 60/353,878, filed on Jan. 31, 2002.

(51) Int. Cl.
*A63B 21/00* (2006.01)

(52) U.S. Cl. ..... 482/106; 482/107; 482/108

(58) Field of Classification Search ..... 482/93–94, 482/98–99, 106–109
See application file for complete search history.

(56) References Cited

U.S. PATENT DOCUMENTS

| | | | |
|---|---|---|---|
| 772,906 | A | 10/1904 | Reach |
| 848,272 | A | 3/1907 | Thornley |
| 1,053,109 | A | 2/1913 | Reach |
| 1,422,888 | A | 7/1922 | Reeves et al. |
| 1,672,944 | A | 6/1928 | Jowett |
| 1,779,594 | A | 10/1930 | Hall |
| 1,917,566 | A | 7/1933 | Wood |
| 3,647,209 | A | 3/1972 | La Lanne |
| 3,758,109 | A | 9/1973 | Bender |
| 3,771,785 | A | 11/1973 | Speyer |
| 3,825,253 | A | 7/1974 | Speyer |
| 3,912,261 | A | 10/1975 | Lambert, Sr. |
| 3,913,908 | A | 10/1975 | Speyer |
| D244,628 | S | 6/1977 | Wright |
| 4,029,312 | A | 6/1977 | Wright |
| 4,076,236 | A | 2/1978 | Ionel |
| RE31,113 | E | 12/1982 | Coker et al. |
| 4,411,424 | A | 10/1983 | Barnett |
| 4,453,710 | A | 6/1984 | Plötz |
| 4,529,197 | A | 7/1985 | Gogarty |
| 4,529,198 | A | 7/1985 | Hettick, Jr. |
| 4,540,171 | A | 9/1985 | Clark et al. |
| 4,546,971 | A | 10/1985 | Raasoch |
| 4,566,690 | A | 1/1986 | Schook |
| 4,568,078 | A | 2/1986 | Weiss |
| 4,575,074 | A | 3/1986 | Damratoski |

(Continued)

FOREIGN PATENT DOCUMENTS

| | | | |
|---|---|---|---|
| EP | 177643 | A1 | 4/1986 |

(Continued)

OTHER PUBLICATIONS

UK fitness supplies.co.uk, located at http://www.ukfitness-supplies.co.uk, 3 pages (First publ. date unknown, website pages printed on Aug. 4, 2003).

(Continued)

*Primary Examiner*—Gregory L. Huson
*Assistant Examiner*—Fenn C. Mathew

(57) ABSTRACT

An exercise dumbbell system includes a handle and weight plates maintained in spaced relationship at opposite ends thereof. Weight selectors are movable laterally into and out of engagement with respective weight plates to secure them relative to the handle. Each weight plate is provided with a pathway having at least one notch that opens upward, and at least one groove that is bounded above by a lip. The selectors have respective weight engaging portions that travel along respective pathways to alternatively underlie different combinations of the weights.

16 Claims, 11 Drawing Sheets

U.S. PATENT DOCUMENTS 4,601,466 A 7/1986 Lais
4,624,457 A 11/1986 Silberman et al.
4,627,618 A 12/1986 Schwartz
4,651,988 A 3/1987 Sobel
4,730,828 A 3/1988 Lane
4,743,017 A 5/1988 Jaeger
4,768,780 A 9/1988 Hayes
4,787,629 A 11/1988 DeMyer
4,809,973 A 3/1989 Johns
4,822,034 A 4/1989 Shields
4,878,662 A 11/1989 Chern
4,878,663 A 11/1989 Luquette
4,880,229 A 11/1989 Broussard
4,900,016 A 2/1990 Caruthers
4,900,018 A 2/1990 Ish, III et al.
D307,168 S 4/1990 Vodhanel
4,913,422 A 4/1990 Elmore et al.
4,948,123 A 8/1990 Schook
4,971,305 A 11/1990 Rennex
4,982,957 A 1/1991 Shields
D315,003 S 2/1991 Huang
5,000,446 A 3/1991 Sarno
5,037,089 A 8/1991 Spagnuolo et al.
5,040,787 A 8/1991 Brotman
D321,230 S 10/1991 Leonesio
5,102,124 A 4/1992 Diodati
5,123,885 A 6/1992 Shields
5,131,898 A 7/1992 Panagos
D329,563 S 9/1992 Rasmussen
5,171,199 A 12/1992 Panagos
5,221,244 A 6/1993 Doss
5,263,915 A 11/1993 Habing
5,284,463 A 2/1994 Shields
5,306,221 A 4/1994 Itaru
5,344,375 A 9/1994 Cooper
5,374,229 A 12/1994 Sencil
5,407,413 A 4/1995 Kupferman
D359,778 S 6/1995 Towley, III et al.
5,435,800 A 7/1995 Nelson
D362,776 S 10/1995 Thorn
5,484,367 A 1/1996 Martinez
5,607,379 A 3/1997 Scott
5,628,716 A 5/1997 Brice
5,630,776 A 5/1997 Yang
5,637,064 A 6/1997 Olson et al.
5,669,861 A 9/1997 Toups
5,769,762 A * 6/1998 Towley et al. ..... 482/93
5,779,604 A 7/1998 Towley, III et al.
5,839,997 A * 11/1998 Roth et al. ..... 482/107
5,853,355 A 12/1998 Standish
5,876,313 A 3/1999 Krull
5,879,274 A 3/1999 Mattox
5,971,899 A 10/1999 Towley, III et al.
6,033,350 A 3/2000 Krull
6,039,678 A 3/2000 Dawson
D422,654 S 4/2000 Chen
6,083,144 A * 7/2000 Towley et al. ..... 482/107
6,099,442 A 8/2000 Krull
6,123,651 A 9/2000 Ellenburg
6,149,558 A 11/2000 Chen
6,186,927 B1 2/2001 Krull
6,186,928 B1 2/2001 Chen
6,196,952 B1 3/2001 Chen
6,228,003 B1 5/2001 Hald et al.
6,261,022 B1 * 7/2001 Dalebout et al. ..... 482/107
6,261,211 B1 7/2001 Suarez et al.
6,322,481 B1 11/2001 Krull
6,328,678 B1 12/2001 Romero
6,350,221 B1 2/2002 Krull
6,402,666 B1 6/2002 Krull
6,416,446 B1 7/2002 Krull
6,422,979 B1 7/2002 Krull
6,461,282 B1 10/2002 Fenelon
6,500,101 B1 * 12/2002 Chen ..... 482/107
D468,946 S 1/2003 Harms et al.
D469,294 S 1/2003 Harms et al.
6,540,650 B1 4/2003 Krull
6,629,910 B1 10/2003 Krull
6,656,093 B1 12/2003 Chen
6,669,606 B1 12/2003 Krull
6,679,816 B1 1/2004 Krull
6,682,464 B1 1/2004 Shifferaw
6,719,674 B1 4/2004 Krull
6,733,424 B1 5/2004 Krull
6,746,381 B1 6/2004 Krull
6,749,547 B1 6/2004 Krull
D498,272 S 11/2004 Sanford-Schwentke et al.
D500,820 S 1/2005 Krull
6,855,097 B1 2/2005 Krull
6,872,173 B1 3/2005 Krull
6,902,516 B1 6/2005 Krull
D508,628 S 8/2005 Crawford et al.
2002/0107118 A1 8/2002 Shifferaw
2002/0115539 A1 8/2002 Krull
2002/0183174 A1 12/2002 Chen
2003/0153439 A1 8/2003 Krull
2003/0199368 A1 10/2003 Krull
2003/0199369 A1 10/2003 Krull
2004/0005968 A1 1/2004 Crawford et al.
2004/0005969 A1 1/2004 Chen
2004/0023765 A1 2/2004 Krull
2004/0072661 A1 4/2004 Krull
2004/0138031 A1 7/2004 Krull

FOREIGN PATENT DOCUMENTS

FR 2452296 10/1980
FR 2613237 10/1988
SU 1258447 A1 9/1986
SU 1367987 A1 1/1988
SU 1389789 A2 4/1988
SU 1643024 A1 4/1991
SU 1659073 A1 6/1991
SU 1687271 A1 10/1991
SU 1780780 A1 12/1992
WO WO 03/063969 A2 8/2003
WO WO 03/063969 A3 8/2003
WO WO 03/089070 A1 10/2003

OTHER PUBLICATIONS

"Nautilus Home Health & Fitness Catalog", catalog, Nautilus, Inc., pp. 1-56 (2004).

* cited by examiner

ADJUSTABLE WEIGHT EXERCISE METHODS AND APPARATUS

CROSS-REFERENCE TO RELATED APPLICATION

This is a continuation of U.S. patent application Ser. No. 10/345,427, filed on Jan. 15, 2003, now U.S. Pat. No. 6,719,674 which in turn, claims the benefit of U.S. Provisional Application No. 60/353,878, filed on Jan. 31, 2002.

FIELD OF THE INVENTION

The present invention relates to exercise equipment and more particularly, to methods and apparatus for adjusting weight resistance to exercise.

BACKGROUND OF THE INVENTION

Past efforts have led to various inventions directed toward adjustable weight exercise devices. Some examples of efforts involving dumbbells, barbells, and the like are disclosed in U.S. Pat. No. 4,284,463 to Shields; U.S. Pat. No. 4,529,198 to Hettick, Jr.; U.S. Pat. No. 4,822,034 to Shields; U.S. Pat. No. 5,769,762 to Towley, III et al.; U.S. Pat. No. 5,839,997 to Roth et al.; U.S. Pat. No. 6,099,442 to Krull; and U.S. Pat. No. 6,033,350 to Krull. Despite these advances in the art, room for improvement remains.

SUMMARY OF THE INVENTION

The present invention provides methods and apparatus which facilitate exercise involving the movement of weights subject to gravitational force. Generally speaking, the present invention allows a person to adjust weight resistance by latching a desired number of weights relative to a movable member. The present invention may be applied to weight stack machines and/or to free weight devices such as dumbbells and barbells.

A preferred embodiment of the present invention may be described in terms of a dumbbell system having a handle; weights disposed at opposite ends of the handle and maintained in spaced relationship relative thereto; and latches at opposite ends of the handle that move laterally in increments to selectively engage and disengage desired weights for movement together with the handle. Many features and/or advantages of the present invention will become apparent from the more detailed description that follows.

BRIEF DESCRIPTION OF THE FIGURES OF THE DRAWINGS

With reference to the Figures of the Drawing, wherein like numerals represent like parts and assemblies throughout the several views.

DETAILED DESCRIPTION OF A PREFERRED EMBODIMENT

The present invention is described primarily with reference to a preferred embodiment exercise dumbbell system. However, those skilled in the art will recognize that one or more features and/or combination of features which are disclosed herein with reference to dumbbells may also be applied to other types of exercise equipment, including weight stack machines, for example. Some examples of cross-over applications are disclosed in U.S. Pat. No. 6,033,350 to Krull, which is incorporated herein by reference. Also incorporated herein by reference are the other patents identified in the Background of the Invention, one or more of which may contribute to understanding of the present invention.

Figure 1:
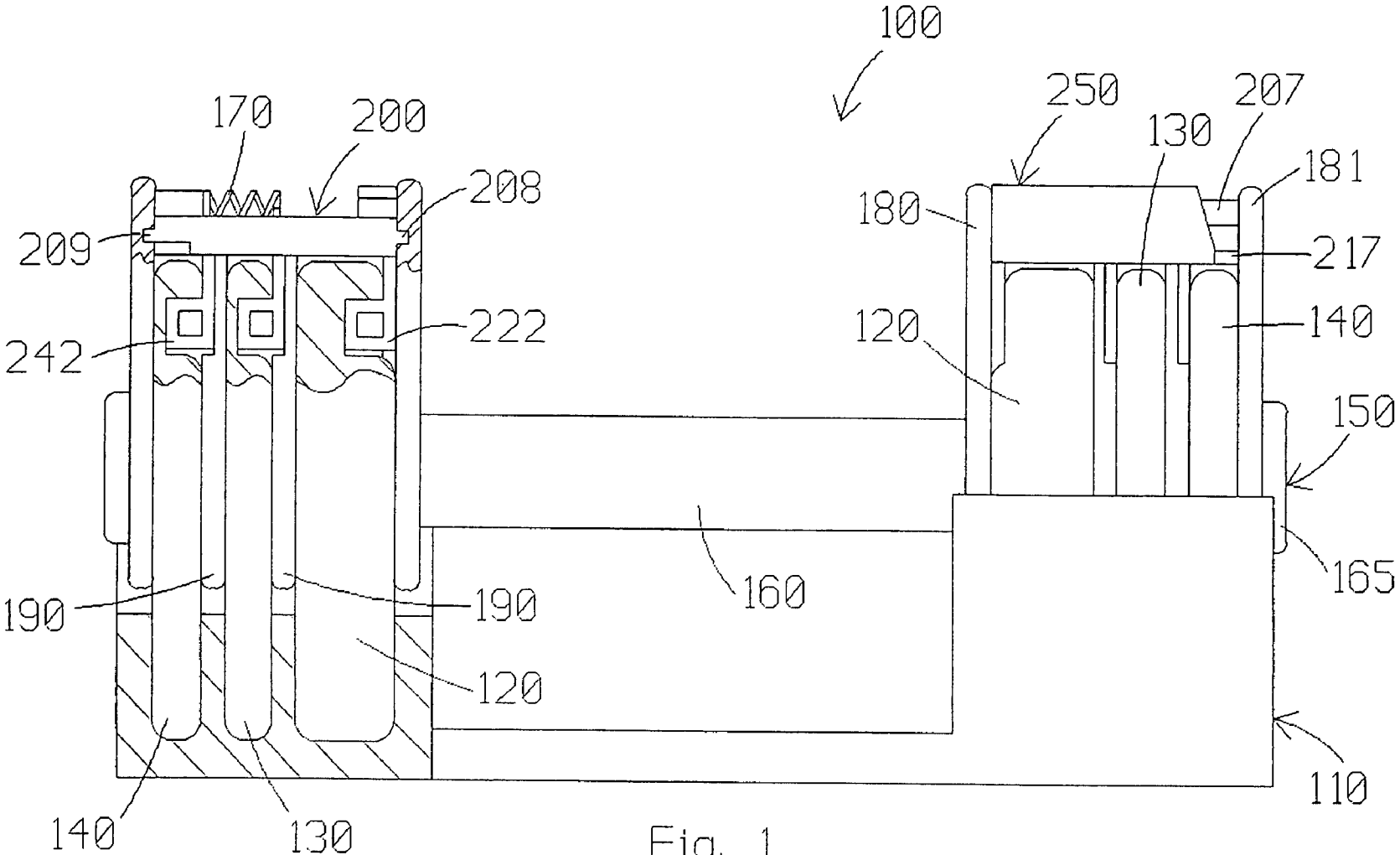
FIG. 1 is a partially sectioned side view of a preferred embodiment exercise dumbbell system constructed according to the principles of the present invention.
Figure 2:
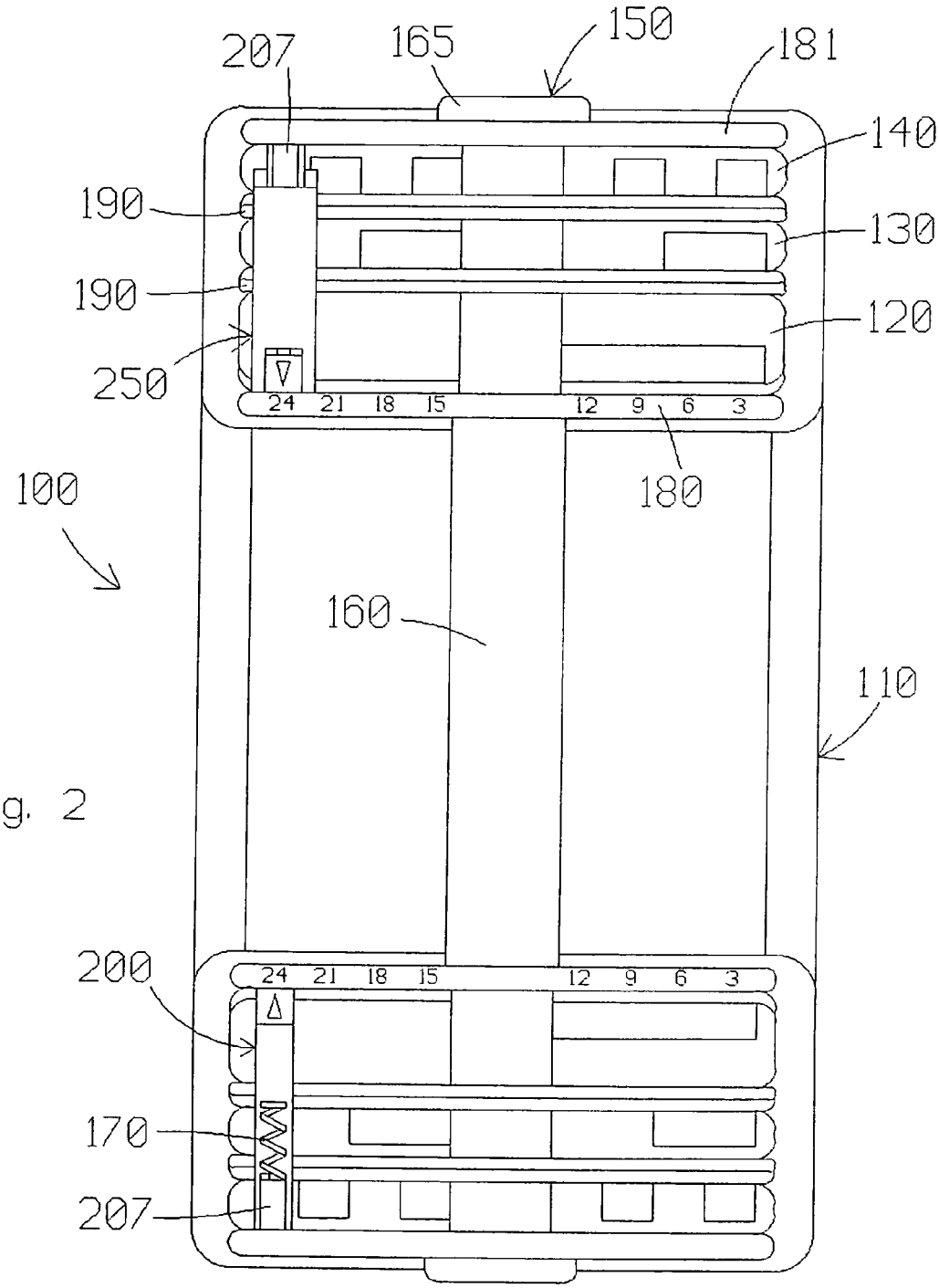
FIG. 2 is a top view of the dumbbell system of FIG. 1 (with one of the latching members removed)
Figure 4:
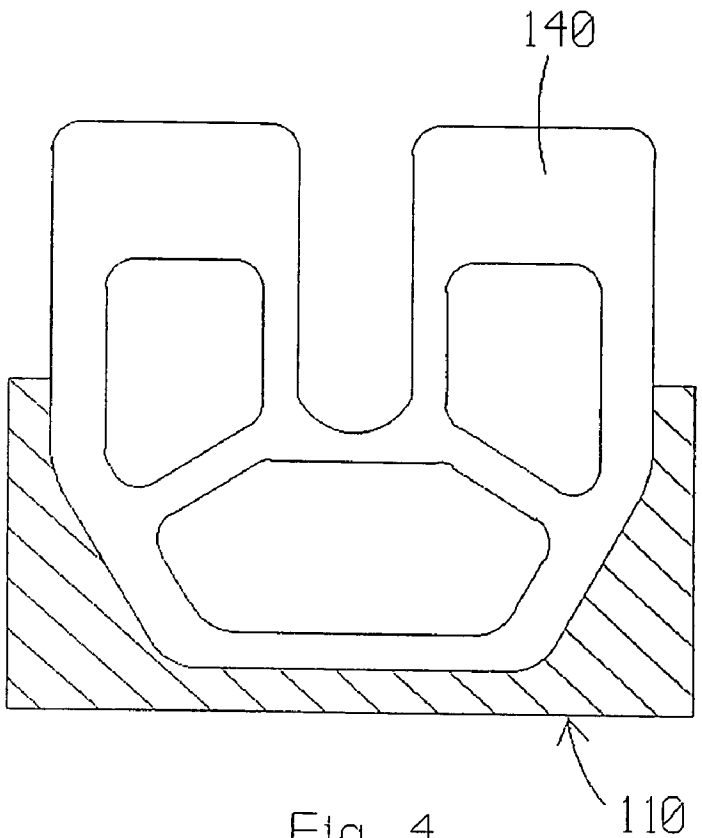
FIG. 4 is a sectioned end view of weight plate and cradle components of the dumbbell system of FIG. 1.
Figure 3:
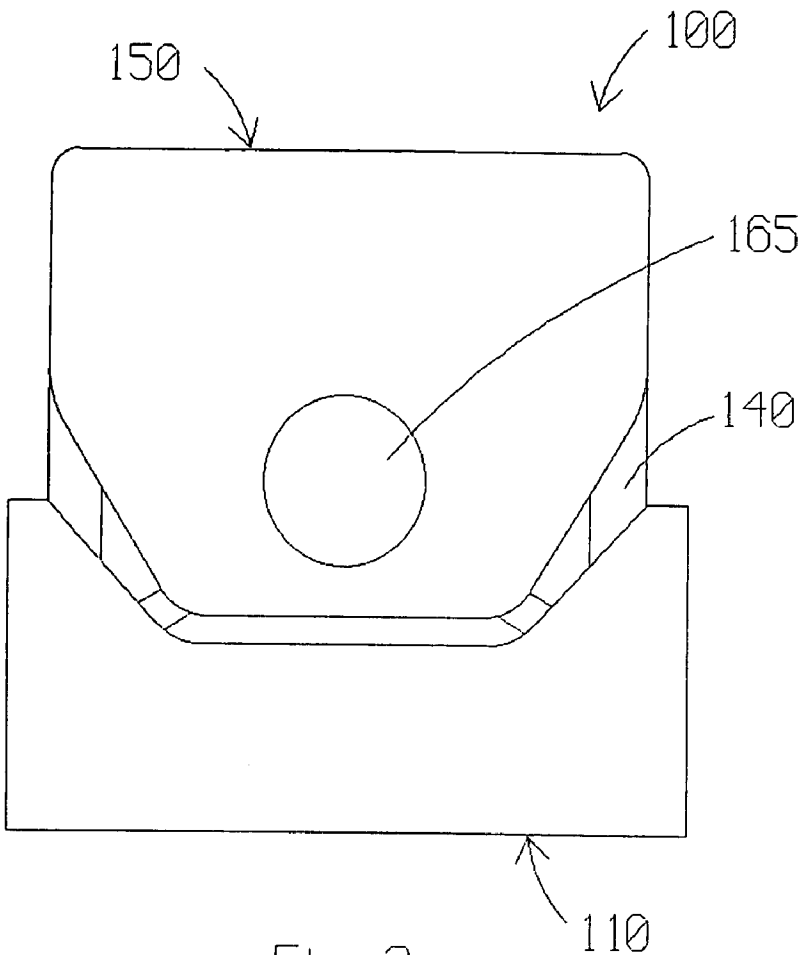
FIG. 3 is an end view of the dumbbell system of FIG. 1.
Figures 5, 6, 7, 8:
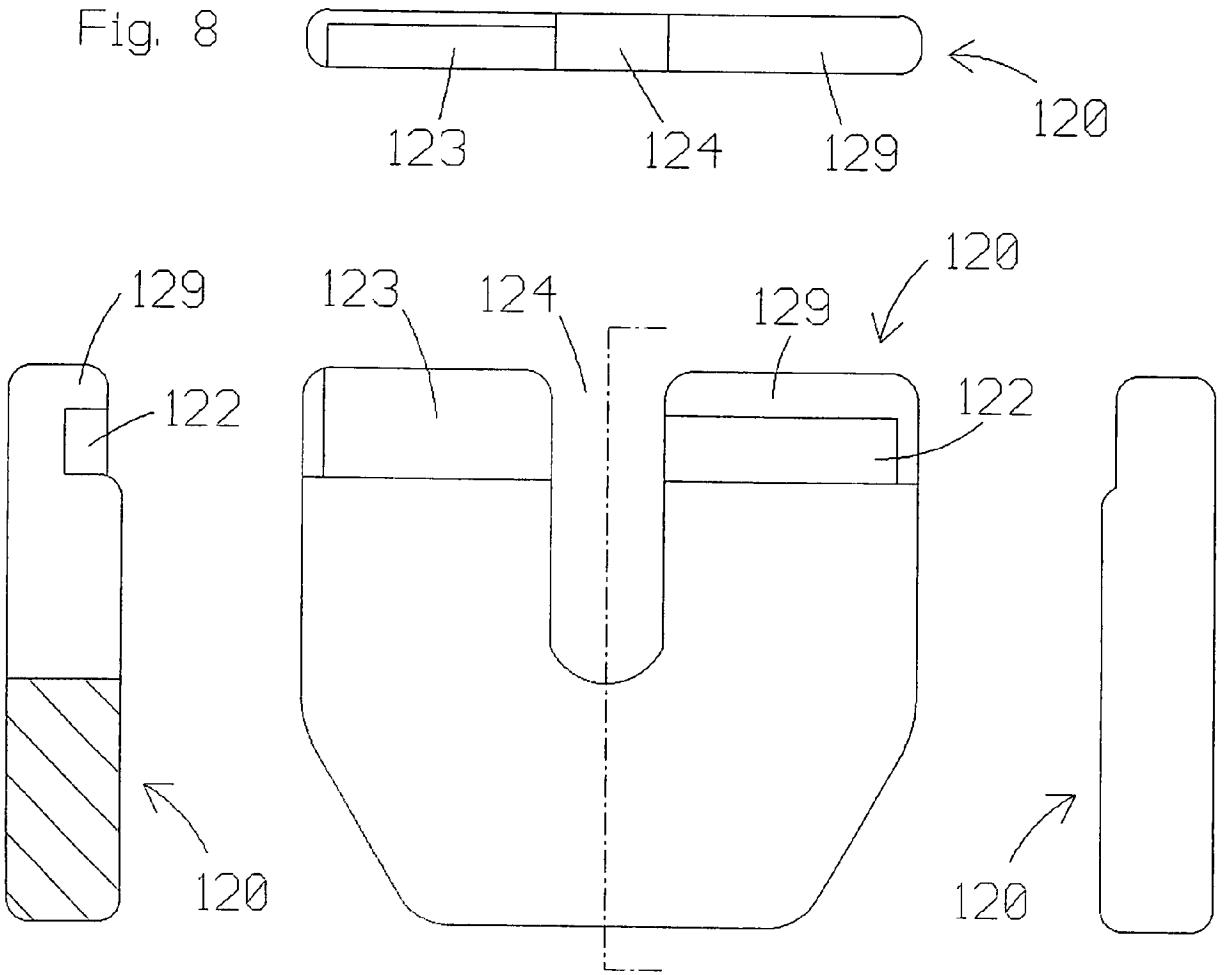
FIG. 5 is an end view of a first weight plate that is a component in the dumbbell system of FIG. 1.
FIG. 6 is a partially sectioned side view of the weight plate of FIG. 5.
FIG. 7 is an opposite side view of the weight plate of FIG. 5.
FIG. 8 is a top view of the weight plate of FIG. 5.
Figure 12:
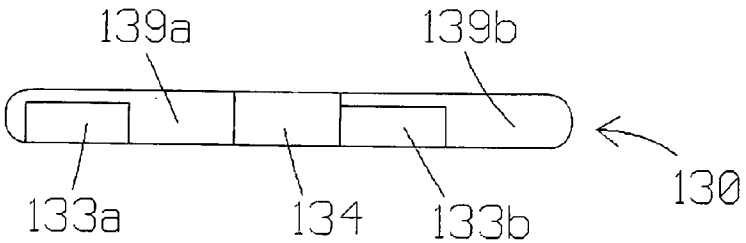
FIG. 12 is a top view of the weight plate of FIG. 9.
Figure 9:
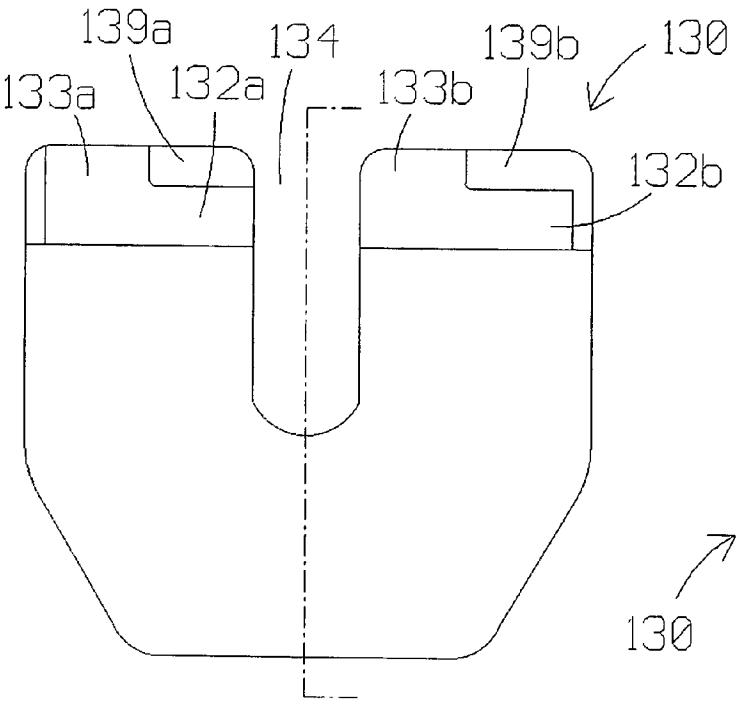
FIG. 9 is an end view of a second weight plate that is a component in the dumbbell system of FIG. 1.
Figure 11:
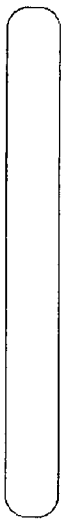
FIG. 11 is an opposite side view of the weight plate of FIG. 9.
Figure 10:
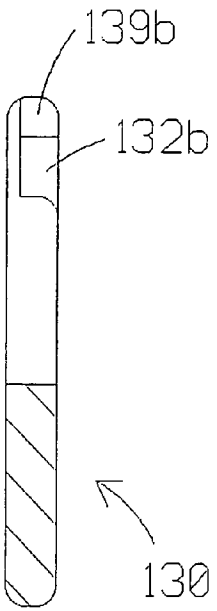
FIG. 10 is a partially sectioned side view of the weight plate of FIG. 9.
Figures 13, 14, 15, 16:
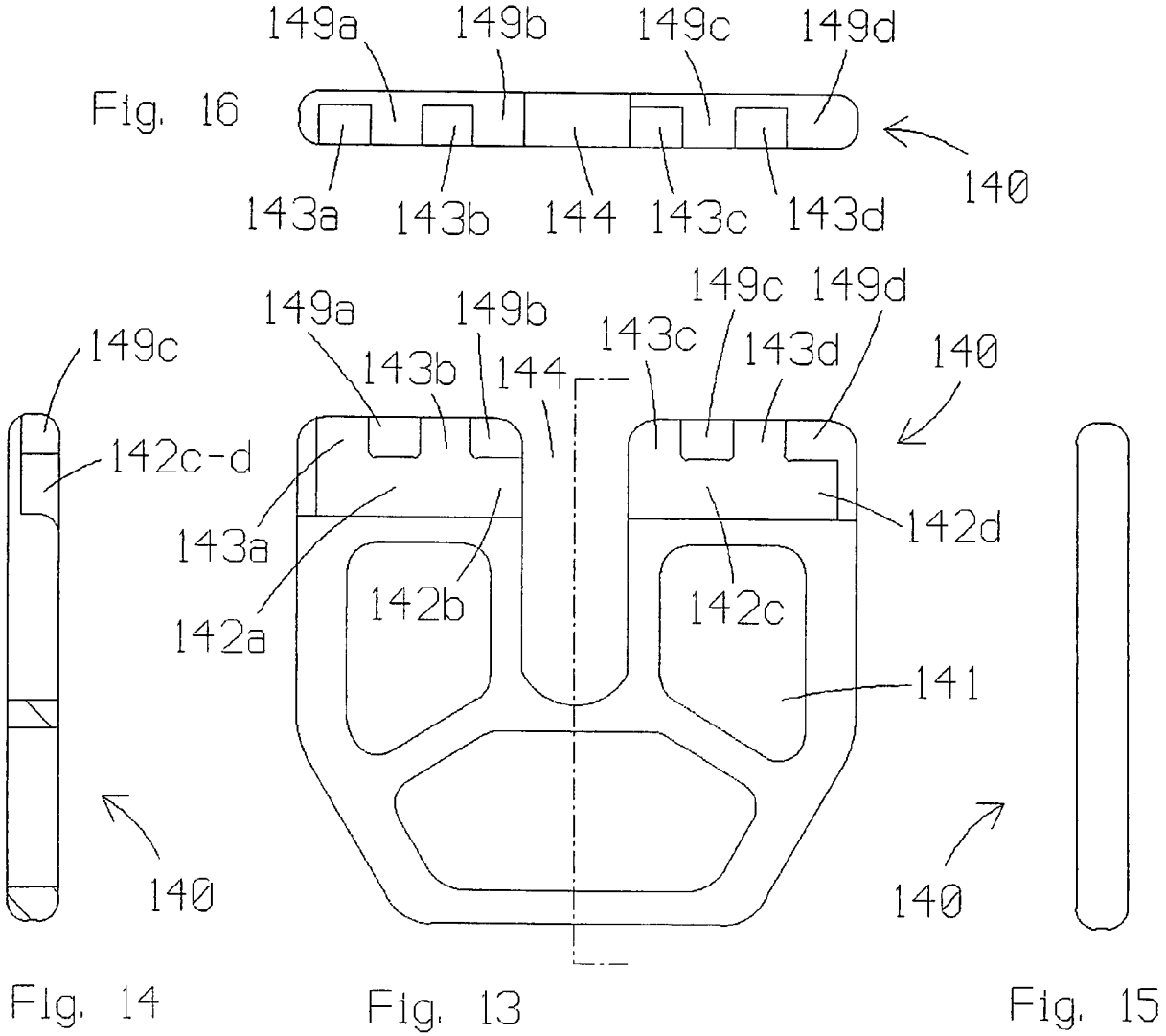
FIG. 13 is an end view of a third weight plate that is a component in the dumbbell system of FIG. 1.
FIG. 14 is a partially sectioned side view of the weight plate of FIG. 13.
FIG. 15 is an opposite side view of the weight plate of FIG. 13.
FIG. 16 is a top view of the weight plate of FIG. 13.

A preferred embodiment dumbbell system constructed according to the principles of the present invention is designated as 100 in FIGS. 1–3. Generally speaking the dumbbell system 100 includes a weight holder or base 110, a plurality of weight plates 120, 130, and 140, and a lifting member or handle assembly 150. The weight plates are connected to the handle assembly in various combinations to provide adjustable resistance to exercise. The weight plates are preferably stored in respective compartments of the cradle when not in use.

Figures 17, 18, 19, 20, 21, 22:
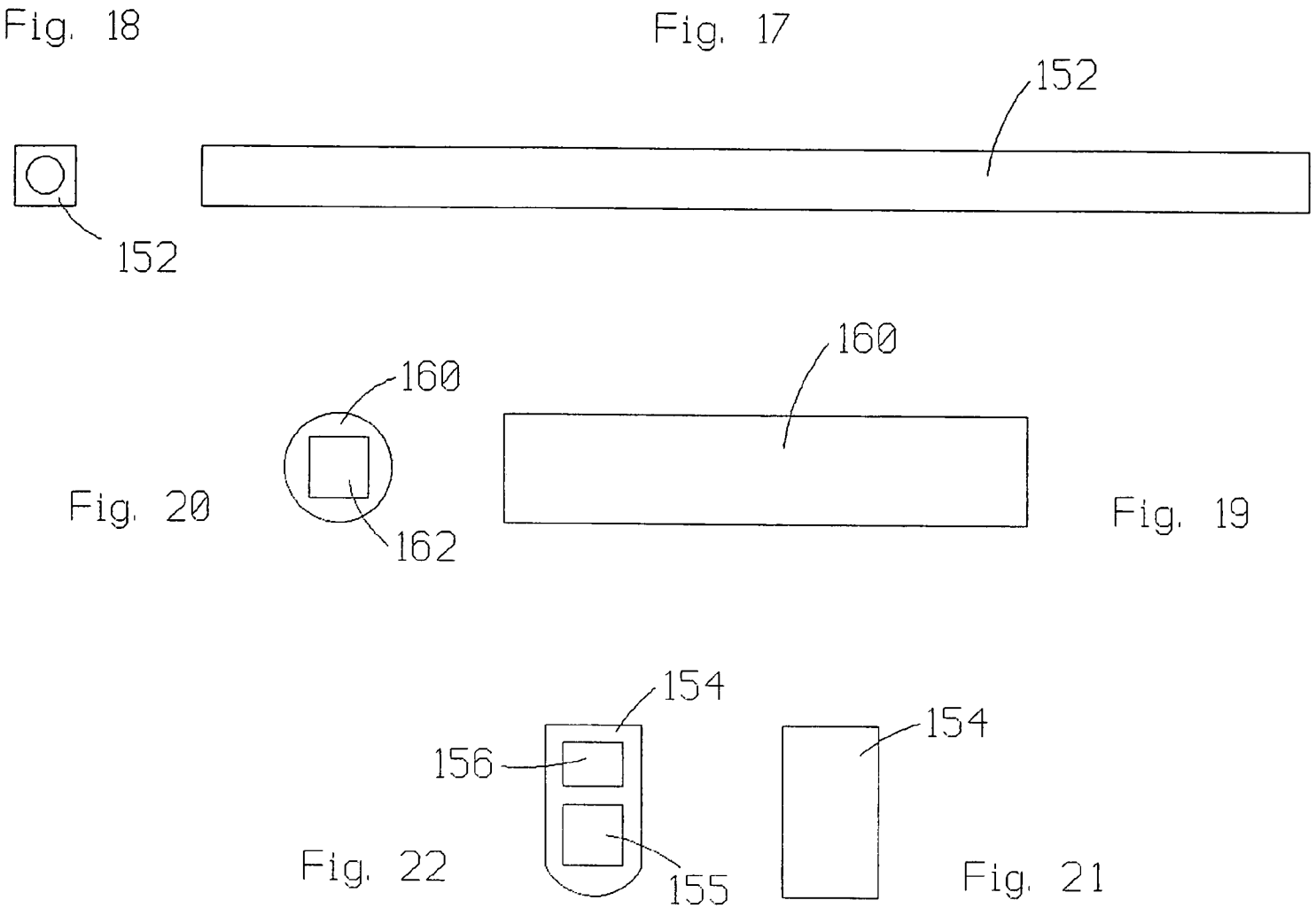
FIG. 17 is a side view of a bar that is a component in the dumbbell system of FIG. 1.
FIG. 18 is an end view of the bar of FIG. 17.
FIG. 19 is a side view of a handle grip that is a component in the dumbbell system of FIG. 1.
FIG. 20 is an end view of the handle grip of FIG. 19.
FIG. 21 is a side view of a spacer that is a component in the dumbbell system of FIG. 1.
FIG. 22 is an end view of the spacer of FIG. 21.

The handle assembly 150 includes a bar 152 (see FIGS. 17–18) that is preferably made of steel and square in cross-section. The bar 152 defines a longitudinal axis that extends perpendicular to the drawing sheet in FIG. 18. The handle assembly 150 also includes a handle grip 160 (see FIGS. 19–20) that is preferably a cylindrical tube made of plastic. The handle grip is provided with an axially extending opening 162 that is comparable in size and shape to the cross-section of the bar. As a result, the handle grip fits snugly onto the bar and resists rotation relative thereto.

Figure 25:
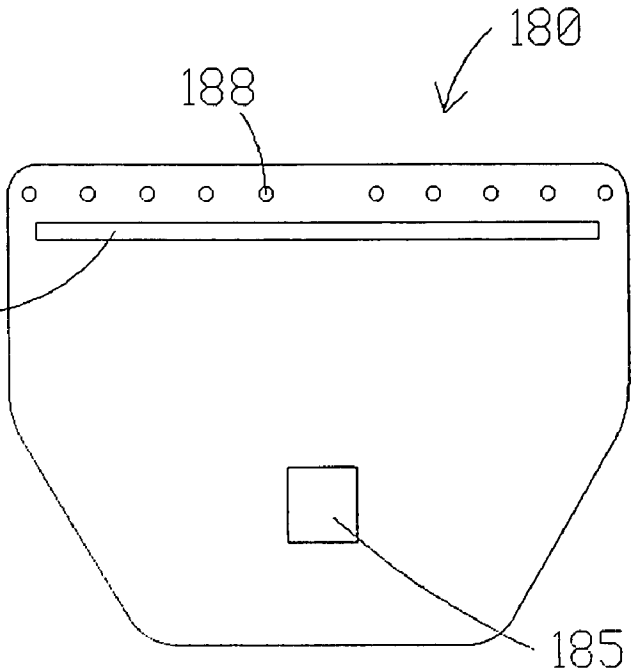
FIG. 25 is an opposite end view of the end plate of FIG. 23.
Figure 24:
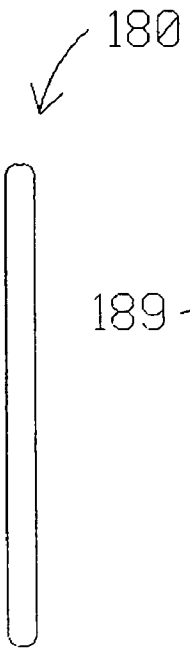
FIG. 24 is a side view of the end plate of FIG. 23.
Figure 23:
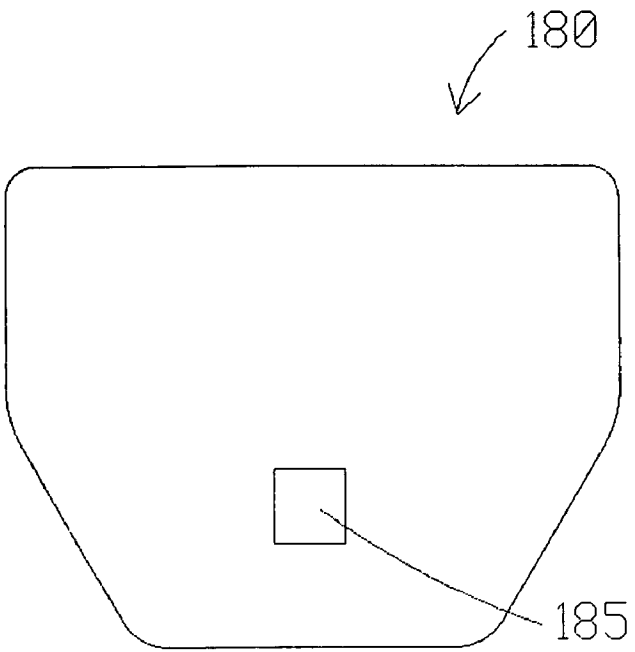
FIG. 23 is an end view of an end plate that is a component in the dumbbell system of FIG. 1.

The handle assembly 150 also includes two inner end plates 180 (see FIGS. 23–25) that are preferably made of plastic. Each inner end plate is provided with an opening 185 that is comparable in size and shape to the cross-section of the bar 152. As a result, the inner end plates fit snugly onto the bar and resist rotation relative thereto. After the handle grip 160 has been moved onto the middle of the bar, the inner end plates are mounted on opposite ends of the bar and moved into abutment with respective ends of the handle grip. The inner end plates are arranged so that holes 188 and slots 189 face away from the handle grip and are disposed above the bar 152.

The handle assembly 150 also includes two spacers 154 (see FIGS. 21–22) that are preferably made of plastic. Each spacer 154 is provided with an opening 155 that is comparable in size and shape to the cross-section of the bar 152 (and an optional, second opening 156 may extend through each spacer 154, if desired). As a result of the opening 155, each spacer fits snugly onto the bar and resists rotation relative thereto. After the inner end plates 180 have been mounted onto opposite ends of the bar, the spacers are similarly mounted on each end of the bar and moved into abutment with respective inner end plates. Each spacer is arranged relative to the bar so that its rounded edge faces downward.

Figure 28:
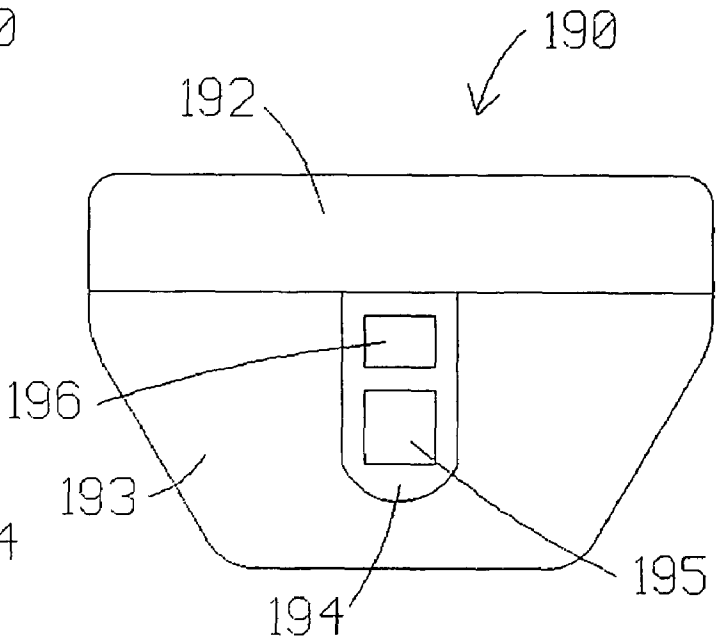
FIG. 28 is an opposite end view of the intermediate plate of FIG. 26.
Figure 27:
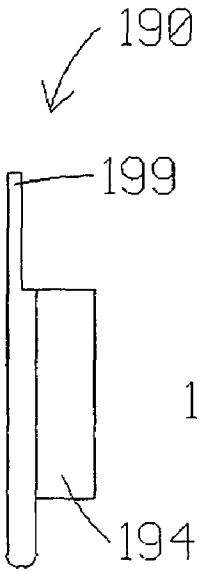
FIG. 27 is a side view of the intermediate plate of FIG. 26.
Figure 26:
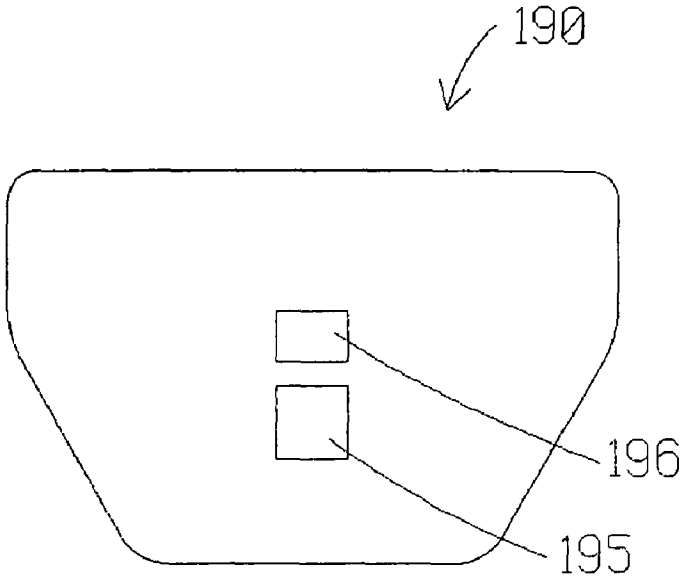
FIG. 26 is an end view of an intermediate plate that is a component in the dumbbell system of FIG. 1.
Figure 31:
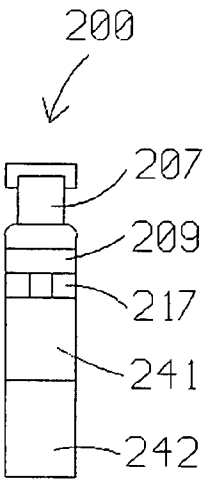
FIG. 31 is an opposite end view of the weight selector of FIG. 29.
Figure 32:
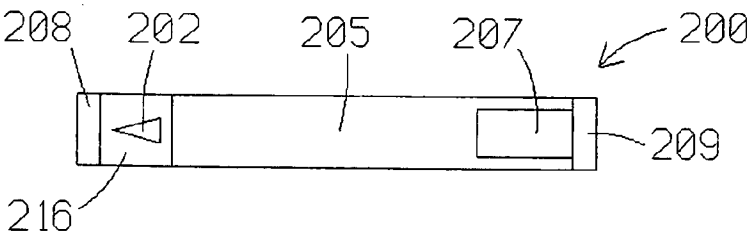
FIG. 32 is a top view of the weight selector of FIG. 29.
Figure 29:
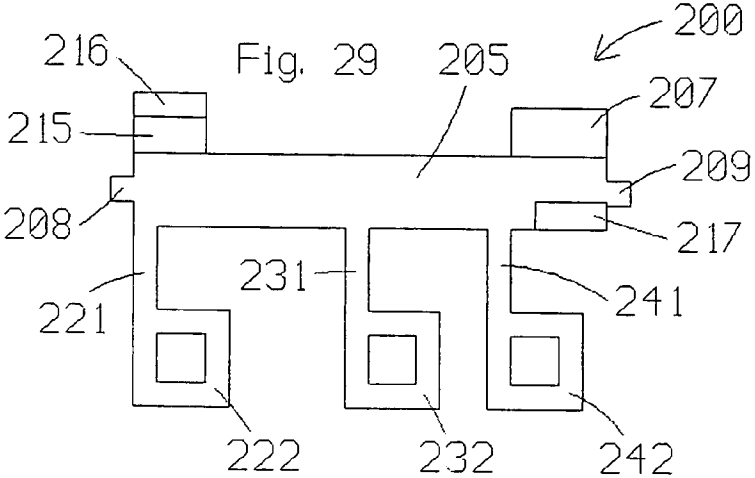
FIG. 29 is a side view of a weight selector that is a component of the dumbbell system of FIG. 1.
Figure 33:
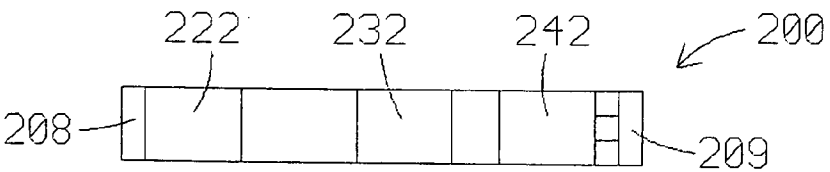
FIG. 33 is a bottom view of the weight selector of FIG. 29.
Figure 30:
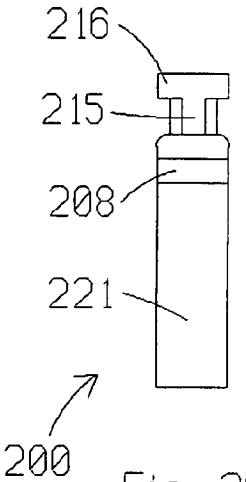
FIG. 30 is an end view of the weight selector of FIG. 29.
Figure 36:
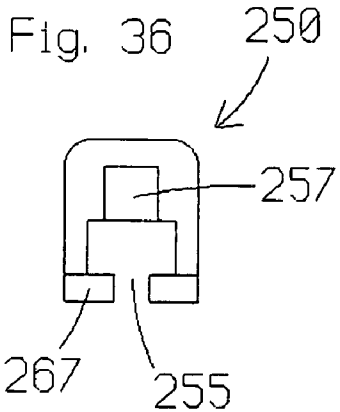
FIG. 36 is an opposite end view of the weight selector of FIG. 34.
Figure 37:
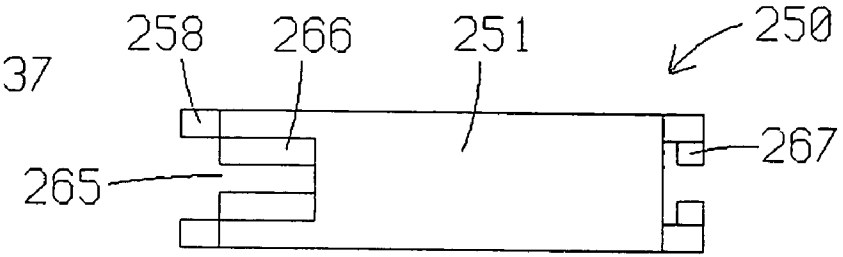
FIG. 37 is a top view of the weight selector of FIG. 34.
Figure 34:
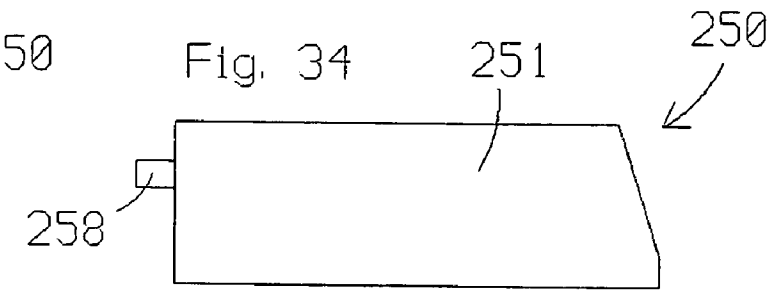
FIG. 34 is a side view of a latching member that is a component of the dumbbell system of FIG. 1.
Figure 38:
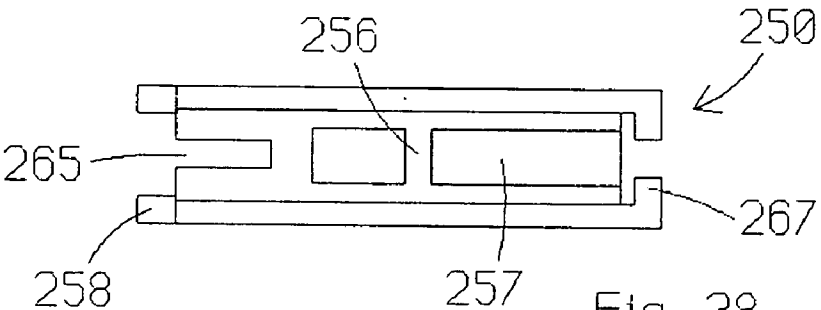
FIG. 38 is a bottom view of the weight selector of FIG. 34.
Figure 35:
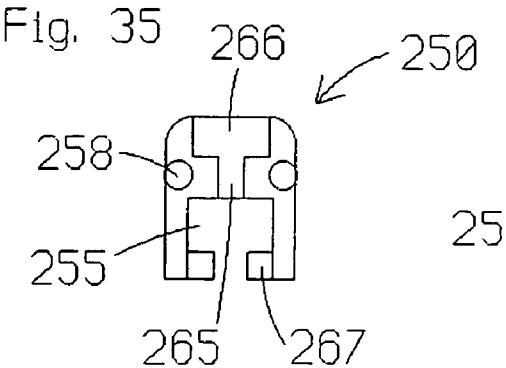
FIG. 35 is an end view of the latching member of FIG. 34.

The handle assembly 150 also includes four intermediate plates 190 (see FIGS. 26–28) that are preferably made of plastic. Each intermediate plate 190 is provided with an opening 195 that is comparable in size and shape to the cross-section of the bar 152 (and an optional, second opening 196 may also extend through each intermediate plate 190, if desired). As a result of the opening 195, each intermediate plate fits snugly onto the bar and resists rotation relative thereto. After the inner end plates 180 have been mounted onto opposite ends of the bar 152, the spacers are similarly mounted on opposite ends of the bar and moved into abutment with respective spacers 154.

For reasons described below, each intermediate plate 190 has a relatively thinner portion 192 that extends upward to a squared top edge 199, and a relatively thicker portion 193 that extends downward to a rounded bottom edge. A spacer 194 projects axially outward from the thicker portion of the intermediate plate, and the spacer 194 is identical in cross-section to the spacer 154. Each intermediate plate is arranged relative to the bar 152 so that its edge 199 faces upward, and its spacer 194 aligns with a respective spacer 54 and extends away from the handle grip 160.

The handle assembly 150 also includes two outer end plates 181, which may be identical to the inner end plates 180 (for purposes of manufacturing efficiency), or which may be distinctly configured to serve location specific purposes. After the intermediate plates 190 have been mounted on opposite ends of the bar 152, the outer end plates are mounted on opposite ends of the bar and moved into abutment with respective spacers 194. The outer end plates are arranged so that holes 188 and slots 189 face toward the handle grip 160 and are disposed above the bar.

The sum of the axially measured dimensions of the handle grip 160, the inner end plates 180, the spacers 154, the intermediate plates 190, and the outer end plates 181 is preferably slightly greater than the length of the bar 152. As a result, fasteners 165 may be threaded into bores in opposite ends of the bar in a manner that clamps the other components therebetween. Each fastener 165 has a threaded shaft (not shown), and a head that overlies a portion of a respective outer end plate 181.

The handle assembly 150 also includes two weight selectors 200 (see FIGS. 29–33) that are preferably made of plastic. Each weight selector 200 includes a main beam 205 that is configured to extend axially between an inner end plate 180 and an outer end plate 181 on a respective end of the handle assembly 150. Tabs 208 and 209 extend axially outward from respective ends of the beam and into the slots 189 in respective end plates 180 and 181. The tabs cooperate with the grooves to slidably retain the associated weight selector relative to respective end plates 180 and 181. The upper edges 199 of the intermediate plates 190 are available to serve as intermediate guides or supports for respective weight selectors. Three weight supports extend downward from the beam 205 on each weight selector. Each weight support includes a respective leg 221, 231, or 241 and a respective foot 222, 232, or 242. Each weight selector 200 is arranged so that its feet project axially away from the handle grip 160. Subject to physical constraints imposed by the other components and/or modifications to such components, the breadth of the weight selector ends and/or legs may be increased to help maintain proper alignment of the selectors (parallel to the longitudinal axis of the handle grip 160).

The handle assembly 150 also includes two latching members 250 (see FIGS. 34–38) that are preferably made of plastic. Each latching member includes an inverted U-shaped shell 251 that is configured for grasping. Each latching member 250 is slidably mounted on a respective weight selector 200. In this regard, a downwardly opening channel 255 in the latching member accommodates the beam 205, and pegs 267 on one end of the latching member extend into grooves 217 in a corresponding end of the beam. Also, a slot 265 in an opposite end of the latching member accommodates a rail 215 that projects upward from the opposite end of the beam, and an associated recess 266 in the latching member accommodates a flange 216 mounted on top of the rail.

Each latching member 250 is provided with a relatively higher and narrower channel 257 that is configured to accommodate a helical spring (designated as 170 in FIGS. 1–2). An inner end of the channel 257 is bounded by a wall 256, and an outer end of the channel 257 aligns with a block 207 on the weight selector 200. When the handle assembly 150 is fully assembled, each spring 170 is maintained in compression between a respective wall 256 and a respective block 207.

Posts 258 extend axially outward from the end of each latching member 250 opposite the spring 170. The posts 258 are configured and arranged to fit into adjacent holes 188 in a respective inner end plate 180. The posts 258 cooperate with the holes 188 to prevent unintentional lateral movement of the latching member 250 and the associated weight selector 200 relative to respective plates 180 and 181. The springs 170 bias the posts 258 toward latched positions relative to respective inner end plates. As a result, a user must pull a latching member away from the handle grip 160 before moving the associated weight selector 200 laterally relative to the associated plates 180 and 181 (perpendicular to the longitudinal axis defined by the handle grip 160.

The base 110 (see FIGS. 1–4) may be described in terms of two upwardly opening boxes that are fixed in place relative to one another. Each box is divided into compartments that are configured to maintain respective weight plates 120, 130, and 140 in alignment relative to one another and respective ends of the handle assembly 150.

One of the weight plates 120 is shown by itself in FIGS. 5–8. The plate 120 may be described as generally U-shaped, and is preferably made of cast iron. The plate 120 has a smooth face, and an opposite, contoured face. On one side of the contoured face, an upwardly opening notch or gap 123 extends laterally across the plate 120. On an opposite side of the contoured face, a groove or slot 122 extends laterally across the plate 120 and is bounded above by a lip 129. The two sides of the plate 120 are separated by a central slot 124 that extends through the plate, and is configured to accommodate a respective spacer 154.

The plate 120 is slightly thicker beneath the slot 122 and the gap 123, and this axially measured thickness is preferably slightly less than the axially measured length of the spacer 154. In other words, the plate 120 is configured to fit between an inner end plate 180 and an adjacent intermediate plate 190. As shown in FIG. 1, the relatively smaller axial thickness of the upper portion of the plate 120 creates a gap relative to the inner end plate 180 to accommodate the leg 221 on a respective weight support 200. Also, the slot 122 and the gap 123 in the weight plate 120 are configured and arranged to define a pathway for the foot 222 on the weight support. When the foot 222 occupies a position within the slot 122, the weight plate 120 is constrained to move together with the handle assembly 150. On the other hand, when the foot 222 occupies a position with the gap 123 (or slot 124), the handle assembly 150 is movable upward relative to the weight plate 120.

One of the weight plates 130 is shown by itself in FIGS. 9–12. The plate 130 may be described as generally U-shaped, and is preferably made of cast iron. The plate 130 has a smooth face, and an opposite, contoured face. On one side of the contoured face, an upwardly opening notch or gap 133*a* extends laterally across part of the plate 130, and a groove or slot 132*a* extends laterally across another part of the plate 130 and is bounded above by a lip 139*a*. On an opposite side of the contoured face, another upwardly opening notch or gap 133*b* extends laterally across part of the plate 130, and another groove or slot 132*b* extends laterally across another part of the plate 130 and is bounded above by a lip 139*b*. The two sides of the plate 130 are separated by a central slot 134 that extends through the plate, and is configured to accommodate the spacer 194 on a respective intermediate plate 190.

The axially measured length of the spacer 194 is slightly greater than the axially measured thickness of the plate 130. In other words, the plate 130 is configured to fit between adjacent intermediate plates 190. As shown in FIG. 1, the relatively smaller axial thickness of the upper portion 192 of the plate 190 creates a gap relative to the plate 130 to accommodate the leg 231 on a respective weight support 200. Also, the slots 132*a–b* and the gaps 133*a–b* in the weight plate 130 are configured and arranged to define a pathway for the foot 232 on the weight support. When the foot 232 occupies a position within either of the slots 132*a–b*, the weight plate 130 is constrained to move together with the handle assembly 150. On the other hand, when the foot 232 occupies a position within either of the gaps 133*a–b* (or slot 134), the handle assembly 150 is movable upward relative to the weight plate 130.

One of the weight plates 140 is shown by itself in FIGS. 13–16. The plate 140 may be described as generally U-shaped, and is preferably made of cast iron. Like the other plates 120 and 130, the plate 140 has a contoured face provided with upwardly opening notches or gaps 143*a–d* that extend laterally across respective portions of the plate 140, and grooves or slots 142*a–d* that extend laterally across other portions of the plate 140 and are bounded above by respective lips 149*a–d*. A central slot 144 extends through the plate, and is configured to accommodate the spacer 194 on a respective intermediate plate 190.

The axially measured length of the spacer 194 is slightly greater than the axially measured thickness of the plate 140. In other words, the plate 140 is configured to fit between an outer end plate 181 and an adjacent intermediate plate 190. As shown in FIG. 1, the relatively smaller axial thickness of the upper portion 192 of the plate 190 creates a gap relative to the plate 140 to accommodate the leg 241 on a respective weight support 200. Also, the slots 142*a–d* and the gaps 143*a–d* in the weight plate 140 are configured and arranged to define a pathway for the foot 242 on the weight support. When the foot 242 occupies a position within any of the slots 142*a–d*, the weight plate 140 is constrained to move together with the handle assembly 150. On the other hand, when the foot 242 occupies a position within any of the gaps 143*a–d* (or slot 144), the handle assembly 150 is movable upward relative to the weight plate 140.

The gaps and slots on each weight plate define a respective selector path having a unique configuration. As a result, the plates 120, 130, and 140 may be selected in any combination at each end of the handle assembly 150. In the preferred embodiment dumbbell system 100, the handle assembly is configured to weigh three pounds; the plates 120 are configured to weigh six pounds; the plates 130 are configured to weight three pounds; and the plates 140 are configured to weigh one and one-half pounds (as a result of mass reduction holes 141). As a result, the handle assembly 150 may be adjusted to provide each of the balanced weight amounts set forth below:

| Selector | Handle | Plates 140 | Plates 130 | Plates 120 | Weight |
|---|---|---|---|---|---|
| "3" | 3 | 0 | 0 | 0 | 3 |
| "6" | 3 | 3 | 0 | 0 | 6 |
| "9" | 3 | 0 | 6 | 0 | 9 |
| "12" | 3 | 3 | 6 | 0 | 12 |
| "15" | 3 | 0 | 0 | 12 | 15 |
| "18" | 3 | 3 | 0 | 12 | 18 |
| "21" | 3 | 0 | 6 | 12 | 21 |
| "24" | 3 | 3 | 6 | 12 | 24 |

As shown in FIG. 2, each of the foregoing weight amounts is preferably displayed on an upper edge of each inner end plate 180 (by means of embossing or a sticker, for example). Also, an indicator 202 is preferably placed on the flange 216 of each weight selector to indicate which of the weight amounts is currently selected. Recognizing that each selector 200 is independently operable, additional dumbbell weight amounts may be selected by engaging different amounts of weight at each end of the handle assembly 150. In this regard, the handle assembly 150 may also be adjusted to weigh 4.5 pounds, 7.5 pounds, 10.5 pounds, 13.5 pounds, 16.5 pounds, 19.5 pounds, and 22.5 pounds. In other words, only three discrete weight plates are required at each end of the dumbbell to provide fifteen different weight levels.

The present invention has been described with reference to a preferred embodiment and a particular application. However, the present invention may be described and/or implemented in other ways, as well. For example, the present invention may be described in terms of an exercise dumbbell system, comprising a handle that defines a longitudinal axis; weight holders secured to opposite ends of the handle; weights sized and configured for insertion into respective weight holders, wherein the weights are provided with upwardly open notches and upwardly closed grooves that cooperate to define respective pathways on respective said weights; and weight selectors movably mounted on respective said weight holders, wherein the weight selectors include axially spaced weight engaging members that are configured to move through respective said pathways and alternatively underlie different combinations of the weights.

The present invention may also be described in terms of an exercise dumbbell system, comprising a handle that defines a longitudinal axis; weight holders mounted on opposite ends of the handle; weights sized and configured to be supported by respective weight holders, wherein the weights are provided with upwardly open gaps and upwardly closed slots that are laterally aligned with one another; and a weight selector movably mounted on the handle for movement relative to the axis and along the gaps and the slots, wherein the weight selector includes axially spaced weight supports that are disposed adjacent respective weights and configured to alternatively occupy the gaps and the slots in respective weights based on the position of the weight selector relative to the handle.

The present invention may also be described in terms of various methods, including a method of adjusting resistance to exercise, comprising the steps of providing a handle that defines a longitudinal axis; securing weight holders to opposite ends of the handle; providing weights sized and configured to be supported by the weight holders, and to define respective selector paths having portions that are upwardly open and portions that are upwardly closed; providing a weight selector having weight supports that are sized and configured to travel along respective selector paths; and movably mounting the weight selector on at least one of the weight holders for movement along the selector paths.

Another such method may be described in terms of providing a handle assembly with a handle that defines a longitudinal axis, weight holders at opposite ends of the handle, and a weight selector having weight engaging members; providing weights sized and configured to be supported by the weight holders and engaged by the weight engaging members; positioning the handle assembly relative to the weights so that the weight engaging members are disposed adjacent respective weights; moving the weight selector laterally relative to the axis to lock a first one of the weights relative to the handle assembly; and further moving the weight selector laterally relative to the axis to lock a second one of the weights relative to the handle assembly.

Recognizing that this disclosure will enable those skilled in the art to derive additional embodiments, applications, and/or improvements, the scope of the present invention is to be limited only to the extent of the following claims.

What is claimed is:

1. A method of adjusting resistance to exercise, comprising the steps of:

providing a lifting member having at least one weight holder;

providing weights sized and configured to be supported by the at least one weight holder, and to define respective selector paths having portions that are upwardly open and portions that are upwardly closed;

providing a weight selector having weight supports that are sized and configured to travel along respective selector paths; and movably mounting the weight selector on the lifting member for movement along the selector paths.

2. The method of claim 1, further comprising the step of providing indicia on upwardly facing portions of the lifting member to alternatively align with the weight selector and indicate how much force is required to lift the lifting member as a function of how many of the weights are currently connected thereto by the weight selector.

3. The method of claim 1, further comprising the step of maintaining the weights in a horizontal array when disengaged from the lifting member.

4. The method of claim 3, further comprising the steps of resting the lifting member on the weights, and selectively moving the weight selector across the tops of the weights to engage a desired combination of the weights.

5. A method of adjusting resistance to exercise, comprising the steps of:

providing a lifting member having at least one weight holder, and a weight selector having weight engaging members;

providing weights sized and configured to be supported by the at least one weight holder and engaged by respective weight engaging members;

positioning the lifting member relative to the weights so that the weight engaging members are disposed adjacent respective weights;

moving the weight selector in a direction parallel to an interface defined between adjacent weights to lock a first one of the weights relative to the lifting member; and further moving the weight selector in said direction to lock a second one of the weights relative to the lifting member.

6. The method of claim 5, further comprising the step of providing indicia on upwardly facing portions of the lifting member to alternatively align with the weight selector and indicate how much force is required to lift the lifting member as a function of how many of the weights are currently connected thereto by the weight selector.

7. The method of claim 5, further comprising the step of maintaining the weights in a horizontal array when disengaged from the lifting member.

8. The method of claim 5, further comprising the step of moving the weight selector still further in said direction to unlock the second one of the weights relative to the lifting member.

9. A method of adjusting resistance to exercise, comprising the steps of:

providing a handle that defines a longitudinal axis;

securing weight holders to opposite ends of the handle;

providing weights sized and configured to be supported by the weight holders, and to define respective selector paths having portions that are upwardly open and portions that are upwardly closed;

providing a weight selector having weight supports that are sized and configured to travel along respective selector paths; and movably mounting the weight selector on at least one of the weight holders for movement along the selector paths.

10. The method of claim 9, further comprising the step of providing indicia on upwardly facing portions of said at least one the weights holders to alternatively align with the weight selector and indicate how much force is required to lift the lifting member as a function of how many of the weights are currently connected thereto by the weight selector.

11. The method of claim 9, further comprising the step of maintaining the weights in a horizontal array when disengaged from the lifting member.

12. The method of claim 11, further comprising the steps of resting the weight holders on the weights, and selectively moving the weight selector across the tops of the weights to engage a desired combination of the weights.

13. A method of adjusting resistance to exercise, comprising the steps of:

providing a handle assembly with a handle that defines a longitudinal axis, weight holders at opposite ends of the handle, and a weight selector having weight engaging members;

providing weights sized and configured to be supported by the weight holders and engaged by the weight engaging members;

positioning the handle assembly relative to the weights so that the weight engaging members are disposed adjacent respective weights;

moving the weight selector laterally relative to the axis to lock a first one of the weights relative to the handle assembly; and further moving the weight selector laterally relative to the axis to lock a second one of the weights relative to the handle assembly.

14. The method of claim 13, further comprising the step of providing indicia on upwardly facing portions of the handle assembly to alternatively align with the weight selector and indicate how much force is required to lift the lifting member as a function of how many of the weights are currently connected thereto by the weight selector.

15. The method of claim 13, further comprising the step of maintaining the weights in a horizontal array when disengaged from the lifting member.

16. The method of claim 13, further comprising the step of moving the weight selector still further laterally to unlock the second one of the weights relative to the handle assembly.

* * * * *